US005498170A

United States Patent [19]

Tanaka

[11] Patent Number: 5,498,170

[45] Date of Patent: Mar. 12, 1996

[54] WATERPROOF ELECTRICAL CONNECTOR

[75] Inventor: Tsutomu Tanaka, Yokkaichi, Japan

[73] Assignee: Sumitomo Wiring Systems, Ltd., Mie Pref., Japan

[21] Appl. No.: 149,723

[22] Filed: Nov. 10, 1993

[30] Foreign Application Priority Data

Nov. 11, 1992 [JP] Japan ..... 4-084217 U

[51] Int. Cl.[6] ..... H01R 13/52

[52] U.S. Cl. ..... 439/271

[58] Field of Search ..... 439/271, 272, 439/277, 752, 596, 603

[56] References Cited

U.S. PATENT DOCUMENTS

| | | | |
|---|---|---|---|
| 4,713,021 | 12/1987 | Kobler | 439/272 OR |
| 4,768,970 | 9/1988 | Nestor | 439/281 X |
| 4,944,688 | 7/1990 | Lundergan . | |
| 5,104,253 | 4/1992 | Zielinski et al. | 439/271 X |
| 5,108,303 | 4/1992 | Maeda et al. | 439/271 OR |
| 5,197,899 | 3/1993 | Akeda | 439/271 OR |
| 5,240,431 | 8/1993 | Yagi et al. | 439/271 OR |

FOREIGN PATENT DOCUMENTS 0356222 2/1990 European Pat. Off. .

0424887 5/1991 European Pat. Off. .

OTHER PUBLICATIONS

Patent Abstracts of Japan, vol. 17, No. 150 (E–1339) Mar. 25, 1993.

Patent Abstracts of Japan, vol. 13, No. 268 (E–775) Jun. 20, 1989.

*Primary Examiner*—Larry I. Schwartz
*Assistant Examiner*—Daniel Wittels
*Attorney, Agent, or Firm*—Wenderoth, Lind & Ponack

[57] ABSTRACT

A waterproof electrical connector includes a housing inserted into a cavity defined in a counterpart of the connector and having a stepped outer contour such that a rear portion of the housing has a larger outer contour than the front portion of the housing. An annular sealing member is fitted to the housing from a front portion of the housing. One end of the sealing member abuts the step for sealing a gap between the housing and an inner peripheral surface of the counterpart defining the cavity. An engagement member engages the outer periphery of the front portion of the housing and abuts the other end of the sealing member. The engagement member also has a larger outer contour than the front portion of the housing.

21 Claims, 7 Drawing Sheets

Prior Art

WATERPROOF ELECTRICAL CONNECTOR

BACKGROUND OF THE INVENTION

1. Field of the Invention

This invention relates to a waterproof electrical connector electrically interconnecting electrical circuits or equipment in a severe environmental condition such as in an engine room of an automobile vehicle.

2. Description of the Prior Art

FIG. 10 illustrates one of conventional waterproof connectors. A housing 1 of the connector comprises a sleeve 4 having a terminal aperture 3 into which a female terminal member 2 is inserted, and a hood 5 surrounding the sleeve 4. A connector seal 6 is closely attached to an outer periphery of the sleeve 4 so as to be located between the sleeve 4 and the hood 5.

An upper interior portion of the sleeve 4 serves as the terminal aperture 3. An elastic engagement piece 7 is formed at the bottom of the terminal aperture 3 and an engagement protrusion 8 is formed on a distal end of the engagement piece 7 to protrude into the terminal aperture 3.

A counterpart connector 9 to be fitted with the above-described connector has a cylindrical shape so that the sleeve 4 of the connector can be inserted into it and so that it can be inserted into the hood 5. The connector seal 6 is compressed to be inserted between an inner peripheral face of the connector 9 and an outer peripheral face of the sleeve 4.

FIG. 10 is a sectional view of a conventional waterproof electrical connector.

When the terminal member 2 is thrust into the terminal aperture 3 through its rear opening, a distal end of the terminal member 2 is engaged with the engagement protrusion 8 such that the engagement piece 7 is deflected downwards. Once the terminal member 2 has been inserted into the terminal aperture 3 to a predetermined position, the engagement piece 7 returns to its former state and the engagement protrusion 8 enters an aperture formed in the underside of the terminal member 2 such that the terminal member 2 is held in position.

When the waterproof connector is connected to the counterpart connector 9, the waterproof connector is thrust into the connector 9 so that the sleeve 4 invades the cylindrical interior of the connector 9. Then, the connector seal 6 positioned at the innermost end of the sleeve 4 is squeezed between the outer peripheral face of the sleeve 4 and the inner peripheral face of the counterpart connector 9, thereby closely adhering both of them to prevent invasion of water.

In the above-described conventional connector, the attachment of the connector seal 6 is troublesome since the connector seal 6 is attached to the innermost end of the sleeve 4 surrounded by the hood 5. Furthermore, it is difficult to confirm whether the connector seal 6 assumes its normal position.

Furthermore, the elastic engagement piece 7 is formed on the cylindrical peripheral wall defining the terminal aperture 3 to hold the terminal member 2 in its normal position. Consequently, the waterproof connector is difficult to fabricate.

SUMMARY OF THE INVENTION

Therefore, an object of the present invention is to provide a waterproof electrical connector which can be formed readily and wherein the connector seal can be attached readily and reliably.

To achieve this object, the present invention provides a waterproof electrical connector comprising a housing inserted into a cavity defined in a counterpart of the connector, the outer surface of the housing having a step, a generally annular sealing member fitted with the housing through a front portion thereof relative to the direction in which the housing is inserted into the cavity of the counterpart, to thereby abut the step for sealing a gap between the housing and an inner peripheral surface of the cavity, and an engagement member engaging an outer periphery of the housing and abutting one end of the sealing member relative to the direction in which the housing is inserted into the cavity of the counterpart.

The step is formed such that the rear portion of the housing has a larger outer contour. When fitted to the outer periphery of the housing, the sealing member abuts the step, which prevents further movement of the sealing member. Subsequently, the engagement member is engaged with the outer periphery of the housing at a position where it abuts the front end of the sealing member engaged with the step. Since the engagement member is engaged with the housing outer periphery, the outer contour of the front portion of the connector is enlarged. The annular sealing member is engaged both with the step and with the engagement member such that it is held therebetween to assume its normal position on the outer periphery of the housing.

Accordingly, the sealing member is reliably positioned when it is fitted to the outer periphery of the housing and the engagement member is engaged with the housing.

Preferably, the housing includes a pair of terminal apertures into which a pair of terminals are inserted, respectively. The terminals can be engaged at predetermined positions when received in the terminal apertures, respectively. The terminal apertures extend between and are open to front and rear end surfaces of the housing relative to the direction in which the housing is inserted into the cavity of the counterpart. An engagement aperture communicating with a respective terminal aperture opens at the outer peripheral surface of the housing. The engagement member has engagement convex portions extending into the terminal apertures through the engagement apertures to thereby engage the terminals, respectively. In this case, the terminals can be held in the terminal apertures in position, respectively, when the engagement member is engaged with the housing.

The engagement member may be in the form of a housing cap engageable with the front end of the housing relative to the direction in which the housing is inserted into the cavity of the counterpart, and thereby covering the front end. In this case as well, the housing cap has engagement convex portions which extend through the engagement apertures into the terminal apertures so that the engagement convex portions are engaged with terminals in the terminal apertures, respectively.

Since the connector is formed by the housing and the housing cap, which members can have simple structures, the forming and assembly of the connector is facilitated.

Other objects of the invention will become obvious from the illustrated embodiments about to be described. Various advantages not referred to herein will occur to those skilled in the art upon employment of the invention in practice.

BRIEF DESCRIPTION OF THE DRAWINGS

An embodiment of the invention will be described with reference to the accompanying drawings, in which.

DESCRIPTION OF THE PREFERRED EMBODIMENT

Figure 1:
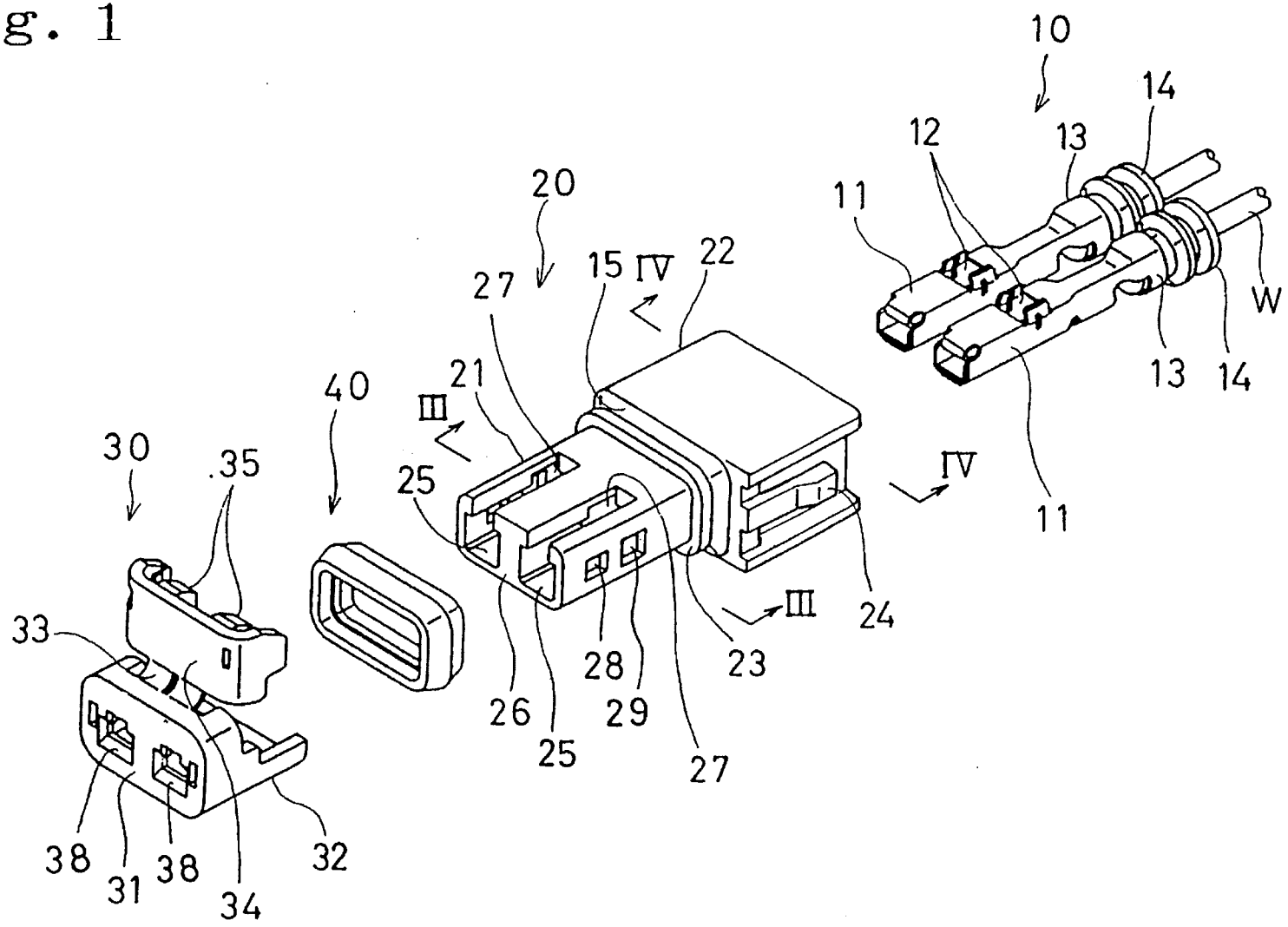
FIG. 1 is an exploded perspective view of an embodiment of the waterproof electrical connector in accordance with the present invention.

An embodiment of the present invention will be described with reference to FIGS. 1 to 9. Referring to FIG. 1, the waterproof electrical connector of the embodiment comprises a pair of female terminal members 10, a housing 20 for enclosing the female terminal members 10, a housing cap 30 attached to a front end of the housing 20 to cover it, and a waterproofing connector seal 40 attached to the outer periphery of the housing 20.

Each female terminal member 10 has at its front end a rectangular cylindrical fitting portion 11 formed by bending the front end and an engagement aperture 12 formed in its upper peripheral face. Each female terminal member 10 further has at its rear end a crimping portion 13 where one end of an electrical wire with which a rubber plug 14 is fitted is crimped such that the wire is connected to the terminal member 10.

The housing 20 formed into a rectangular solid having a rectangular section. The housing 20 is divided into a front slender body portion 21 and a rear enlarged lock portion 22. A stepped portion 23 is formed between the body portion 21 and the lock portion 23. An elastic locking piece 24 is formed on one side of the lock portion 22.

Figure 2:
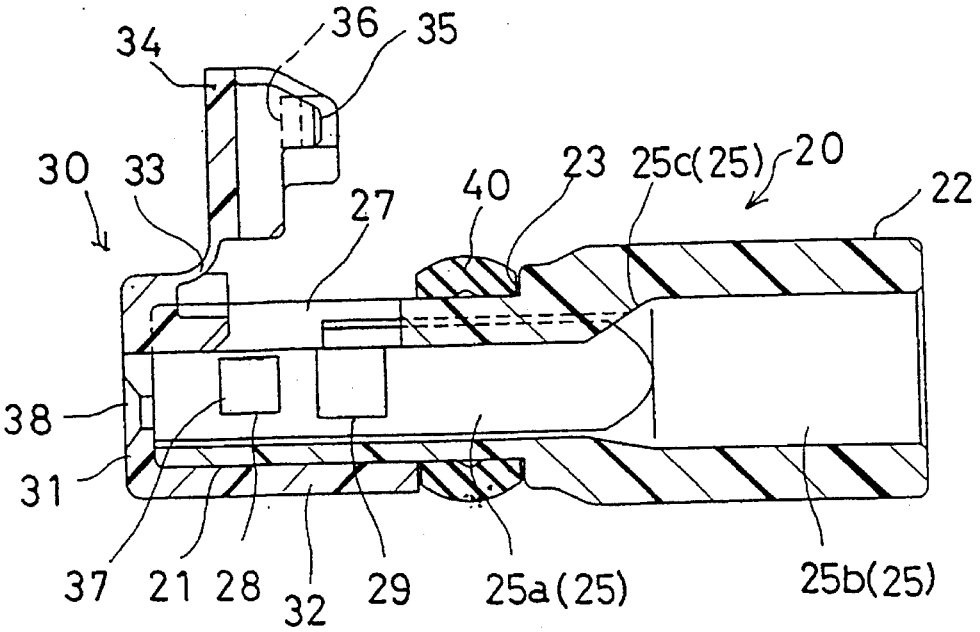
FIG. 2 is a longitudinal sectional view of the connector.
Figure 3:
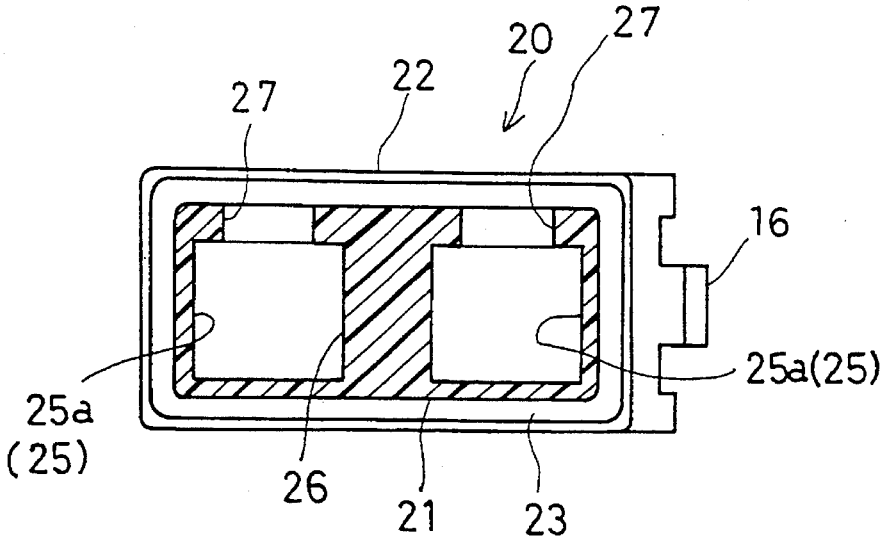
FIG. 3 is a sectional view taken along line III—III in FIG. 1.
Figure 4:
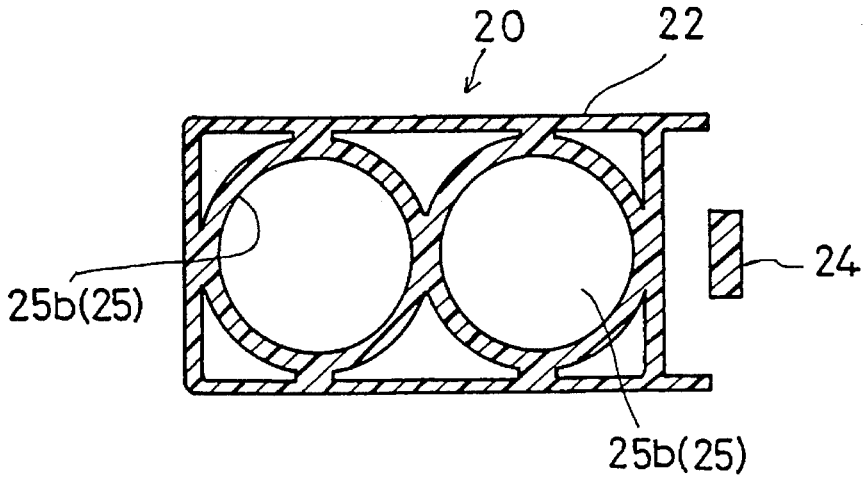
FIG. 4 is a sectional view taken along line IV—IV in FIG. 1.
Figure 5:
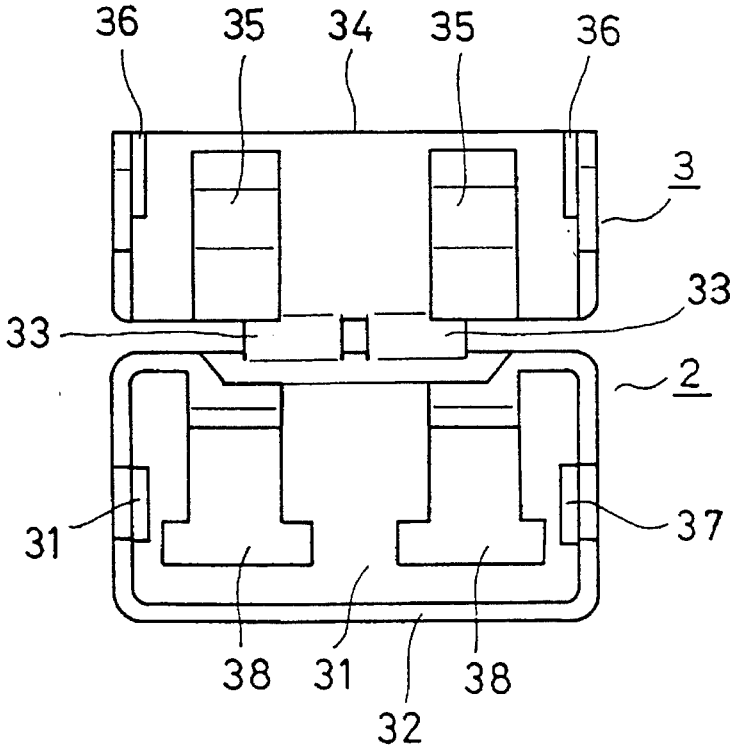
FIG. 5 is a rear view of the housing cap employed in the connector.

Referring now FIGS. 1 and 2, the housing 20 has two terminal apertures 25 extending lengthwisely therethrough and disposed in parallel with a dividing wall 26 provided therebetween. Each terminal aperture 25 has a square aperture portion **25*a* in which the front fitting portion of the terminal member 10 is enclosed. Each terminal aperture 25 further has a circular aperture portion 25*b* in which the rear pressing portion 13 of the terminal member 10 is enclosed. The rubber plug 14 is closely attached to the surface defining the circular aperture portion 25*b*. The square and circular aperture portions 25*a*. 25*b* are open at the front and rear ends of the housing 20, respectively. Each square aperture portion 25*a* communicates with an engagement aperture 27 formed; the end of the housing 20 at its upper peripheral face. Two mount apertures 28 and two lock apertures 29 both communicating with the respective terminal apertures 25 are formed in the right-hand and left-hand sides of the housing 20**.

The housing cap 30 is fitted with the body portion 21 of the housing 20 from its front end. The housing cap 30 comprises a lid portion 31 abutting the distal end of the body portion 21 and a cylindrical portion 32 facing the periphery of the body portion 21. An upper half portion near the open end of the cylindrical portion 32 serves as a retainer portion 34 which is opened and closed by hinge portions 33. Two engagement convex portions 35 are formed on the inner face of the retainer portion 34 so as to assume respective positions where they face the respect ire engagement apertures 27. The engagement convex portions 35 invade the terminal apertures 25 to extend into the engagement apertures 12 of the terminal members 10 respectively. Two attachment pieces 36 are also formed on the inner face of the retainer portion 34 so as to assume respect ire positions where they face the respective lock apertures 29 of the body portion 21. The attachment pieces 36 invade the respective lock apertures 29 to be engaged with the housing 20. Two engagement protrusions 37 are formed on the inner peripheral face of the cylindrical portion 32 so as to assume respective positions where they face the respective mount apertures 28 of the body portion 21 . The engagement protrusions 37 invade the respective mount apertures 28 to be engaged with the housing 20. The lid portion 31 has two windows 38 through which male terminals (not shown) are inserted into the terminal apertures 25, respectively.

The connector seal 40 is formed into an annular shape and has an inner diameter determined so that it is closely attached to the outer periphery of the body portion 21. A middle portion of the connector seal 40 has a thickness larger than its front and rear open ends. The length of the connector seal 40 is determined so as to be approximately equal to the length from the end of the cylindrical portion 32 of the housing 30 to the stepped portion 23 when the housing cap 30 is attached to the body portion 21 of the housing 20.

Figure 7:
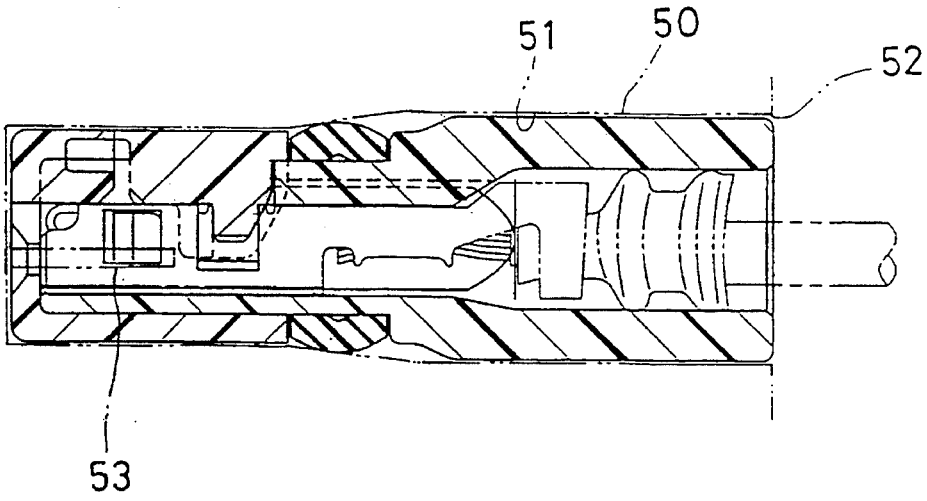
FIG. 7 is a longitudinal sectional view of the connector assembly constituted by the connector inserted in a cavity of the counterpart.

A counterpart member to which the above-described connector is connected has a cavity 50 FIG. 7 into which the housing 20 to which the housing cap 30 and the connector seal 40 are attached is inserted. An inner peripheral wall defining the cavity 50 continuously extends in the direction of its depth from its opening 52. A pair of male terminal members 53 projects from a wall defining the bottom of the cavity 50 toward its opening.

Figure 6:
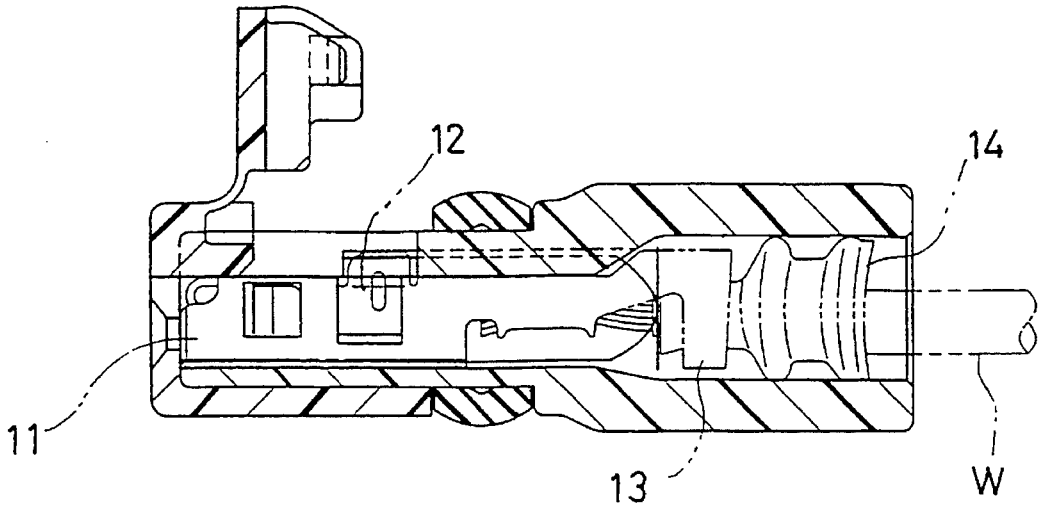
FIG. 6 is a longitudinal sectional view of the connector with the terminal members inserted into the respective terminal apertures.

The use of the waterproof electrical connector will now be described. In assembling the above-described connector, the body portion 21 of the housing 20 is fitted into the annular connector seal 40 from its front end and then, thrust until the rear end face of the connector seal 40 abuts the stepped portion 23. The body portion 21 is then inserted into the cylindrical portion 32 of the housing cap 30. When the body portion 21 is inserted such that its distal end abuts the inner face of the lid portion 31 of the housing cap 30, the engagement protrusions 37 formed on the inner peripheral surface of the cylindrical portion 32 invade the mount apertures 28 formed in the body portion 21, respectively, thereby holding the housing cap 30 in position. The end face of the housing cap 30 abuts the front end face of the connector seal 40 when the housing cap 30 is held in position, so that the connector seal 40 is held between the stepped portion 23 and the end face of the cylindrical portion 32 around the body portion 21. At this time, the retainer 34 is held in a raised state by means of the hinge portion 33, as shown in FIG. 6.

The distal ends of the wire W to which the rubber plug 14 is attached are crimped on the crimping portions 13 of the terminal members 10, respectively. Then, the terminal members 10 are inserted into the terminal apertures 25 from the side of the fitting portions 11 with engagement apertures 12 directed upwards, respectively. When the terminal members 10 are inserted deep into the respective terminal apertures 25, the hinge portion 33 is bent so that the retainer portion 34 is thrust toward the body portion 21. Then, the engagement convex portions 35 of the retainer 34 invade the engagement apertures 12 of the terminal members 10 through the engagement apertures 27 to be engaged with the terminal members 10, respectively. The attachment pieces 36 formed on the inner peripheral face of the retainer 34 invade the respective lock apertures 29 of the body portion 21 when the retainer port ion 34 is fully bent, so that the retainer 34 is incorporated with the cylindrical portion 32 so as to be held closed.

The waterproof connector assembled as described above is inserted through the opening 52 into the cavity 50 of the counterpart member from the side of its housing cap 30. The connector seal 40 held around the body portion 21 is held between the outer face of the body portion 21 and the inner face of the inner wall 51, thereby sealing a gap therebetween. Male terminal members 53 of the counterpart member invade the terminal apertures 25 through the windows 38 of the housing cap 30 and are further fitted into the fitting portions 11 of the female terminal members 10, respectively, thereby being connected to the same, as shown in FIG. 7.

According to the above-described connector, the work of attaching the annular connector seal, to the housing body portion 21 is easy since the body portion 21 is exposed outwards. Subsequently, the housing cap 30 is engaged with the body portion 21 such that the connector seal 40 is held between the stepped portion 23 and the end face of the cylindrical portion 32. Consequently, the removal of the connector seal during transfer of the connector and failure of the connector seal to be mounted can be prevented. Furthermore, should the connector seal fail to be mounted, such failure can be; visually confirmed easily since the connector seal is supposed to be disposed around the housing 20 and accordingly, the connector seal can be reattached with ease.

Figure 8:
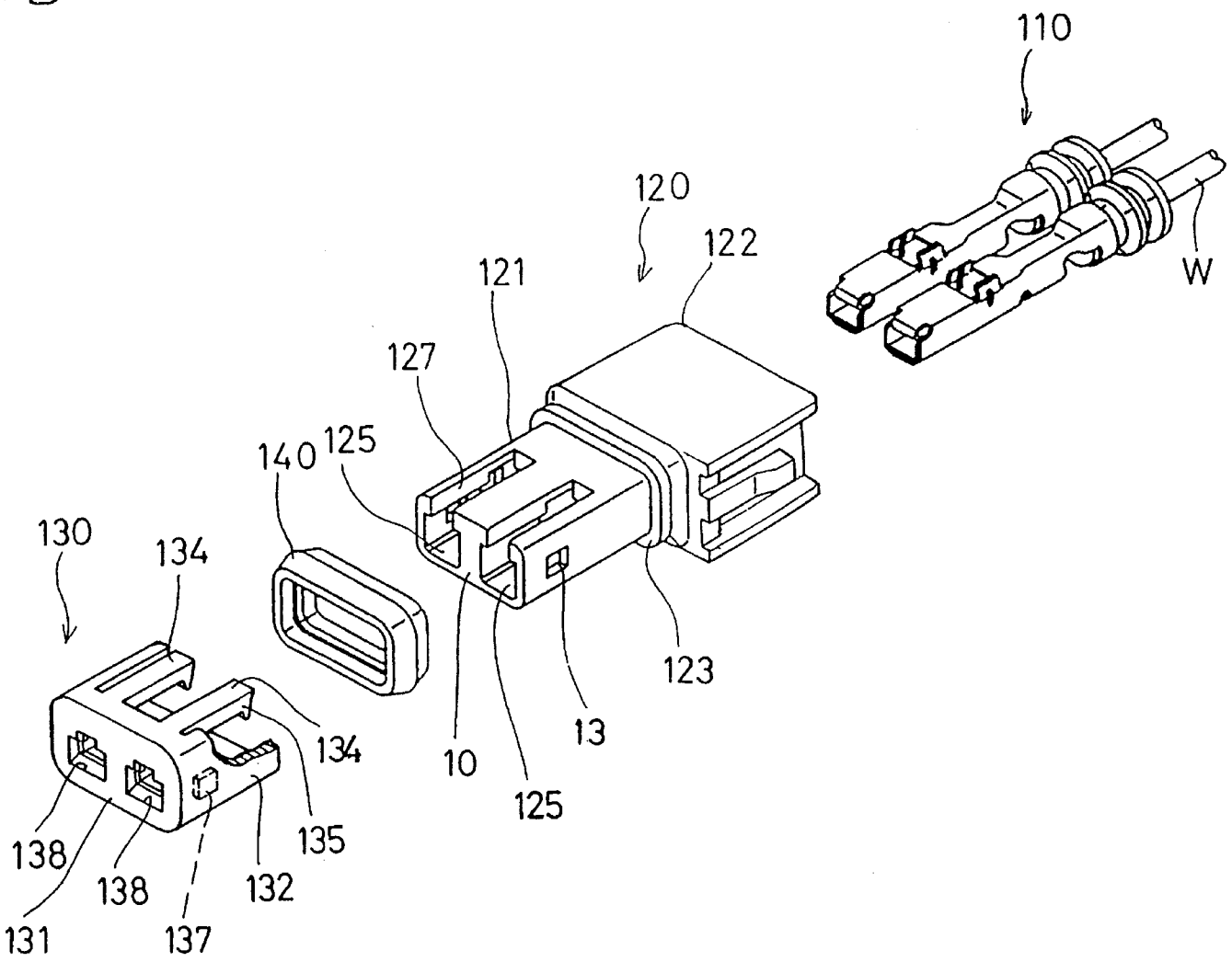
FIG. 8 is an exploded view of a second embodiment of the connector.

FIG. 8 illustrates a modified form of the waterproof connector. In the foregoing embodiment, a part of the cylindrical portion 32 of the housing cap 30 is opened and closed. The engagement protrusions 35 advance into and retreat out of the terminal apertures respectively in association with the part of the cylindrical portion 32 opened and closed. In the modified form, notches are formed to extend from the open end of the cylindrical portion 132 of the housing cap 130 toward the lid portion 131, whereby two elastic lance pieces 134 are provided to be opposite the engagement apertures 127 of the housing 120 respectively. The engagement protrusions 135 are formed on the inner faces of the lance pieces 134 respectively. Each engagement protrusion 135 has an inner side face perpendicular to the longitudinal direction of the lance piece and an outer side face (at the open end of cylindrical portion 132) that is oblique to such longitudinal direction.

According to the above-described construction, the housing 120 is inserted from the distal end of the body portion 121 into the cylindrical portion 132 of the housing cap 130 after connector seal 140 has been attached around the body portion 121 of the housing 120. In this case, the engagement protrusions 135 are inserted along the respective engagement apertures 127 each extending to the distal end of the body portion 121. The terminal members 110 are inserted into the respective terminal apertures 125 once the engagement protrusions 135 have been inserted and the engagement protrusions 137 have been received in the mount apertures 128 of the body portion 121, respectively. The distal ends of the terminal members 110 abut the engagement protrusions 135 in the terminal apertures 125 received in the terminal apertures 125, respectively. However, because the terminal members 110 abut the inclined faces of the engagement protrusions 135, respectively, the terminal members 110 can be further inserted into the respective terminal apertures 125 with the lance pieces 134 being elastically deformed and forced from the respective terminal apertures 125. The engagement protrusions 135 are opposite to the respective engagement apertures 112 when the terminal members 110 have been inserted to assume the normal positions. The lance pieces 134 return to their former shape such that the engagement protrusions 135 are received in the respect ire engagement apertures 112. Each terminal member 110 can be prevented from falling out since the perpendicular inner side face of each engagement protrusion 135 abuts the edge portion of the terminal member 110 defining the engagement aperture 112.

Figure 9:
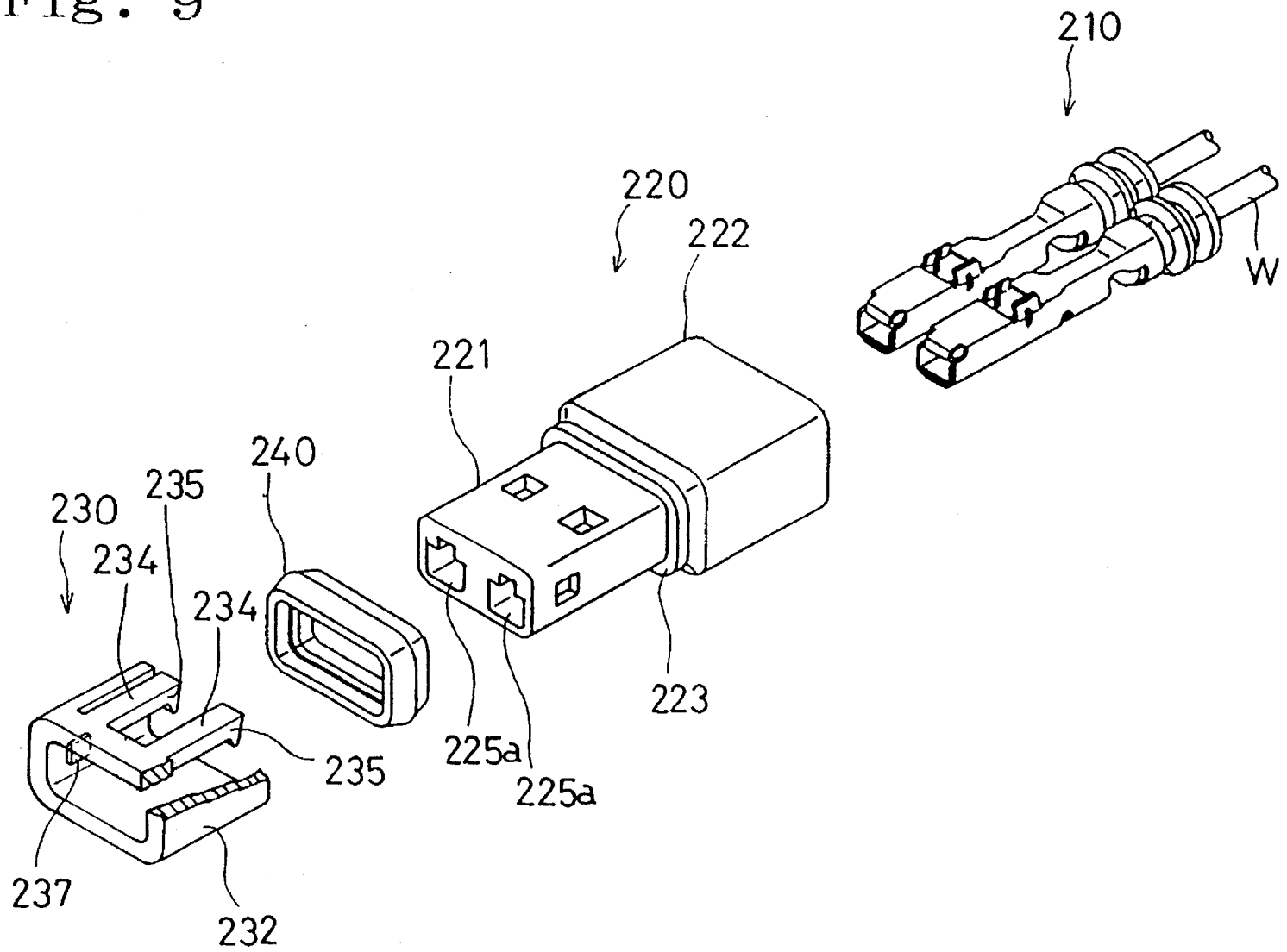
FIG. 9 is an exploded view of another embodiment of the connector.
Figure 10:
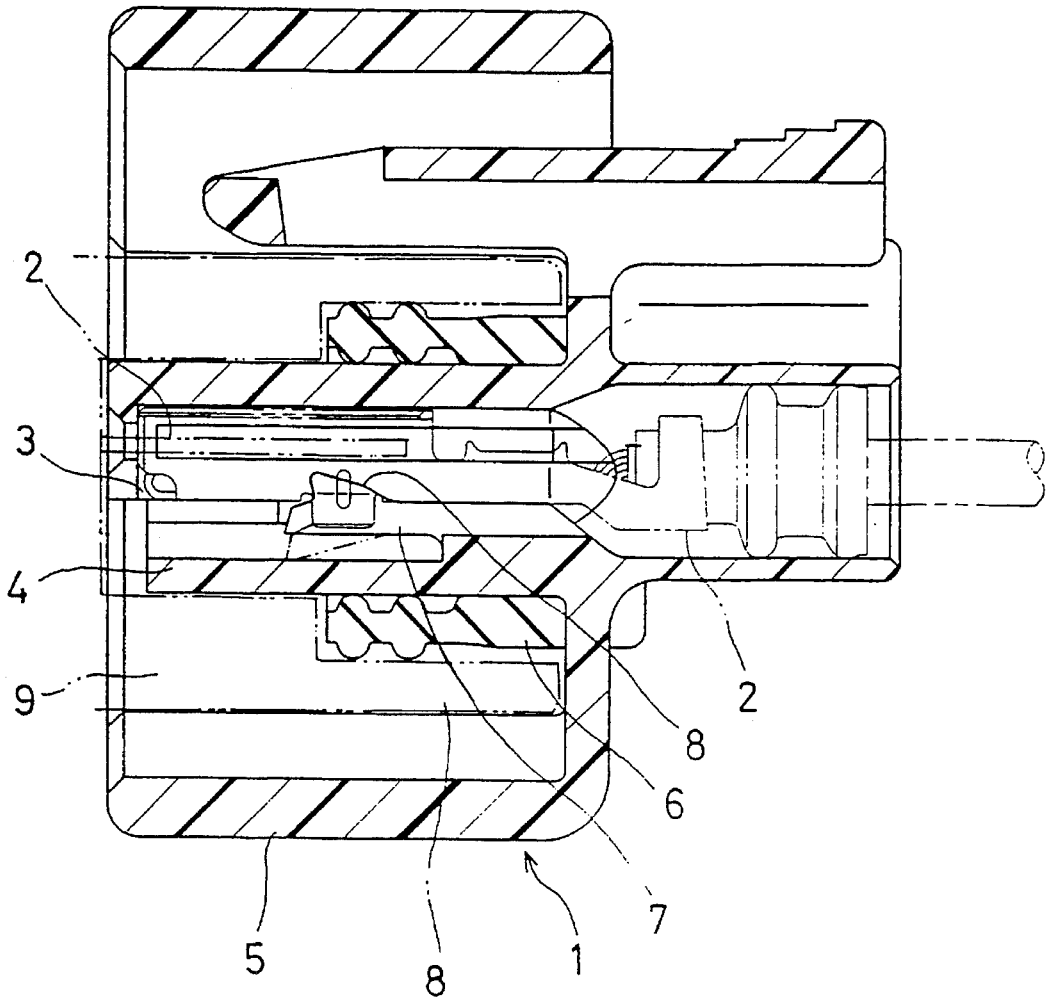
FIG. 10 is a sectional view of a conventional waterproof electrical connector.

FIG. 9 illustrates another modified form. In the above-described modified form, the housing cap 130 provided with the lance pieces 134 includes the cylindrical portion 132 and the lid portion 131 closing one end of the cylindrical portion 132. In the modified form shown in FIG. 9, an engagement ring 230 serving as the engagement member includes only the cylindrical portion 232. The opening of the square portion **225*a* of each terminal aperture 225 is reduced so as to have the same configuration as each window 138 of the housing cap 130**.

In the above-described construction, the body portion 221 is fitted into the engagement ring 230 after the connector seal 240 is attached around the body portion 222 of the housing 220. The connector seal 240 is then held between the stepped portion 223 and the engagement ring 230 to be held around the body portion 221.

The foregoing disclosure and drawings are merely illustrative of the principles of the present invention and are not to be interpreted in a limiting sense. The only limitation is to be determined from the scope of the appended claims.

We claim:

1. A waterproof electrical connector comprising:

a housing to be inserted into a cavity defined in a counterpart of the connector, the outer surface of the housing having a step such that a rear portion of the housing, in the direction in which the housing is to be inserted into the cavity of the counterpart, is provided on one side of the step and a front portion of the housing is provided on the other side of the step, said rear portion having a larger outer contour than that of said front portion;

a generally annular sealing member fitted to and extending around the front portion of said housing, said sealing member having opposite ends in the direction in which the housing is to be inserted into the cavity of the counterpart, one of said ends of said sealing member abutting the step of said housing, and said sealing member being configured to establish a seal between the housing and an inner peripheral surface of the counterpart defining the cavity; and an engagement member engaging an outer periphery of the front portion of said housing and abutting the other of said ends of the sealing member, said engagement member having an outer contour that is also larger than that of the front portion of said housing.

2. A connector according to claim 1, wherein the housing defines a pair of terminal apertures into which a pair of terminals are to be inserted, respectively, the terminal apertures extending between and open at front and rear ends of the housing in the direction in which the housing is to be inserted into the cavity of the counterpart, wherein the housing also defines engagement apertures open at the outer peripheral surface of the front portion of the housing and communicating with said terminal apertures, and wherein the engagement member has convex portions extending through the engagement apertures into said terminal apertures to thereby engage, respectively, terminals that are received within the terminal apertures.

3. A connector according to claim 1, wherein the engagement member is a cap covering the front end of the housing in the direction in which the housing is to be inserted into the cavity of the counterpart.

4. A connector according to claim 2, wherein the engagement member is a cap covering the front end of the housing in the direction in which the housing is to be inserted into the cavity of the counterpart.

5. A connector according to claim 4, wherein the convex portions of the engagement member are supported by a resilient portion of the engagement member that allows the convex portions to advance into and retreat out of the engagement apertures, respectively.

6. A connector according to claim 5, wherein the engagement member has a cylindrical portion extending around the outer periphery of said front portion of the housing, and a hinge connecting one part of the cylindrical portion of the engagement member to the remainder of the engagement member such that said one part is openable and closeable, and wherein the convex portions are disposed at the inner periphery of the engagement member.

7. A connector according to claim 6, wherein each of said engagement apertures extends to the front end of the housing in the direction in which the housing is to be inserted into the cavity of the counterpart.

8. A connector according to claim 4, wherein each of said engagement apertures extends to the front end of the housing in the direction in which the housing is to be inserted into the cavity of the counterpart, said engagement member has a cylindrical portion extending around the outer periphery of the front portion of said housing, and each of said convex portions is disposed at the inner periphery of the cylindrical portion of said engagement member at a position facing a respective one of the engagement apertures.

9. A connector according to claim 5, wherein the engagement member has a cylindrical portion extending around the outer periphery of the front portion of said housing, said cylindrical portion having notches therein forming elastic pieces, and wherein the convex portions protrude at the inner periphery of the elastic pieces as opposed to the engagement apertures, respectively.

10. A connector according to claim 9, wherein each of said engagement apertures extends to the front end of the housing in the direction in which the housing is to be inserted into the cavity of the counterpart.

11. A connector according to claim 1, wherein the engagement member has the shape of a ring and extends around the front portion of said housing.

12. A connector according to claim 2, wherein the engagement member has the shape of a ring and extend around the front portion of said housing, and the convex portions of the engagement member are supported by a resilient portion of the engagement member that allows the convex portions to advance into and retreat out of the engagement apertures, respectively.

13. A waterproof electric connector assembly comprising:

a first connector having an inner peripheral surface extending from an end thereof so as to define a cavity open at said end; and a second connector comprising a housing disposed in the cavity of the first connector, the housing having a step such that a rear portion of the housing, closest to the open end of said cavity, is provided on one side of the step and a front portion of the housing is provided on the other side of the step, said rear portion having a larger outer contour than that of said front portion;

a generally annular sealing member fitted to and extending around the front portion of said housing, said sealing member having opposite ends in the direction of depth of the cavity of said first connector, one of said ends of said sealing member abutting the step of said housing, said sealing member establishing a seal between the housing and the inner peripheral surface of the first connector; and an engagement member engaging an outer periphery of the front portion of said housing and abutting the other of said ends of the sealing member, said engagement member having an outer contour that is also larger than that of the front portion of said housing.

14. A waterproof electrical connector comprising:

a housing defining a pair of terminal apertures configured to receive a pair of terminals, respectively, the terminal apertures extending between and open to front and rear ends of the housing in the direction in which the housing is to be inserted into a cavity of a counterpart of the electrical connector, said housing also defining engagement apertures open at an outer peripheral side surface of the housing and communicating with said terminal apertures, respectively; and a housing cap engaged with said housing and covering a front end of the housing with respect to the direction in which the housing is to be inserted into the cavity of the counterpart, the housing cap having convex portions extending through the engagement apertures into the terminal apertures so that the convex portions engage terminals that are received in the terminal apertures, respectively.

15. A connector according to claim 14, wherein the housing cap has a cylindrical portion extending around the outer periphery of the housing, and a hinge connecting one part of the cylindrical portion to the remainder of the housing cap such that said one part is openable and closeable, and wherein the convex portions are disposed at the inner periphery of the housing cap.

16. A connector according to claim 15, wherein each of said engagement apertures extends to the front end of the housing in the direction in which the housing is to be inserted into the cavity of the counterpart.

17. A connector according to claim 16, wherein the housing includes a front portion at the bottom of the cavity of the counterpart, the respective terminal apertures have ends at which the apertures are open at a distal end surface of the front portion of said housing, and the engagement apertures are open to and extend from the ends of the terminal apertures to a side surface of the housing body, respectively.

18. A connector according to claim 14, wherein the housing retainer has a cylindrical portion extending around the outer periphery of the front portion of said housing, said cylindrical portion having notches therein forming elastic pieces, and wherein the convex portions protrude at the inner periphery of the elastic pieces as opposed to the engagement apertures, respectively.

19. A connector according to claim 18, wherein each of said engagement apertures extends to the distal end surface of a front portion of the housing adjacent the bottom of the cavity of the counterpart.

20. A connector according to claim 19, wherein the respective terminal apertures have ends at which the apertures are open to the distal end surface of the front portion of the housing, and the engagement apertures are open to and extend from the ends of the terminal apertures to a side surface of the front portion of the housing, respectively.

21. A waterproof electric connector assembly comprising:

a first connector having an inner peripheral surface extending from an end thereof so as to define a cavity open at said end;

a second connector comprising a housing disposed in the cavity of the first connector, said housing defining terminal apertures extending between and open to front and rear ends of the housing, engagement apertures open at an outer periphery of a front portion of the housing and communicating with said terminal apertures, respectively, and mount apertures also open at the outer periphery of the front portion of said housing;

terminals received in the terminal apertures of the housing of said first connector, respectively, each of said terminals having an engagement aperture facing a respective one of said engagement apertures of the housing of said second an engagement member extending over the outer periphery of the front portion of said housing, said engagement member including convex portions extending through the engagement apertures of the housing of the second connector and into the engagement apertures of said terminals, whereby the engagement member engages said terminals, and said engagement member including engagement protrusions extending into said mount apertures, respectively, whereby the engagement member engages said housing of the second connector; and a generally annular sealing member fitted to and extending around said housing in said cavity at a position between the end of said first connector and the locations at which the engagement member engages said terminals and the housing of said second connector, said sealing member establishing a seal between the housing of said second connector and the inner peripheral surface of the first connector such that water entering said cavity is inhibited from penetrating to said locations at which the engagement member engages said terminals and the housing of said second connector.

* * * * *